US007665182B2

(12) United States Patent
Kim

(10) Patent No.: US 7,665,182 B2
(45) Date of Patent: Feb. 23, 2010

(54) VACUUM CLEANER AND DAMPER INSTALLATION STRUCTURE THEREOF

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 689 days.

(21) Appl. No.: 11/098,643

(22) Filed: Apr. 5, 2005

(65) Prior Publication Data

US 2006/0021187 A1 Feb. 2, 2006

(30) Foreign Application Priority Data

Jul. 27, 2004 (KR) ..... 10-2004-0058523

(51) Int. Cl.

| | |
|---|---|
| ***A47L 9/22*** | (2006.01) |
| ***A47L 9/28*** | (2006.01) |
| ***F16K 15/00*** | (2006.01) |
| ***F16K 17/00*** | (2006.01) |
| ***F16K 21/04*** | (2006.01) |

(52) U.S. Cl. ..... 15/412; 137/543.19

(58) Field of Classification Search ..... 15/339, 15/412; 220/89.1–89.4; 137/543.19
See application file for complete search history.

(56) References Cited

U.S. PATENT DOCUMENTS

| | | | | |
|---|---|---|---|---|
| 1,938,418 | A * | 12/1933 | Evans | 137/543.19 |
| 2,710,023 | A * | 6/1955 | Blackford et al. | 137/543.19 |
| 3,913,615 | A * | 10/1975 | Cooper | 137/543.19 |
| 4,457,104 | A * | 7/1984 | Hefner | 47/73 |
| 5,546,981 | A * | 8/1996 | Li et al. | 137/543.19 |
| 5,800,409 | A * | 9/1998 | Bruce | 604/523 |
| 6,056,439 | A * | 5/2000 | Graham | 220/89.1 |
| 6,618,960 | B2 * | 9/2003 | Brown | 36/44 |
| 6,651,294 | B2 * | 11/2003 | Ji | 15/339 |
| 6,978,801 | B2 * | 12/2005 | Takahashi | 137/543.19 |
| 2004/0050872 | A1 * | 3/2004 | Masuda | 222/212 |
| 2005/0050679 | A1 * | 3/2005 | Jeon | 15/412 |

* cited by examiner

*Primary Examiner*—Bryan R Muller
(74) *Attorney, Agent, or Firm*—Ked & Associates LLP

(57) ABSTRACT

Provided is a damper installation structure of a vacuum cleaner. The structure includes a damper, and a damper support part concaved into an inner portion of a main body of the vacuum cleaner and having a plurality of support bars. To firmly support the damper, the damper support bars are branched and extended toward an outward direction.

13 Claims, 7 Drawing Sheets

VACUUM CLEANER AND DAMPER INSTALLATION STRUCTURE THEREOF

BACKGROUND OF THE INVENTION

1. Field of the Invention

The present invention relates to a vacuum cleaner, and particularly to a damper formed at a suction side of a motor built in the vacuum cleaner, for preventing the motor from being damaged.

2. Description of the Related Art

A vacuum cleaner is generally classified into a canister vacuum cleaner and an uptight vacuum cleaner. Particularly, the upright vacuum cleaner includes a main body, a nozzle unit and a handle that are integrally formed, so the vacuum cleaner itself is moved when a user pushes or pulls a handle by gripping it. At this time, dusts on the floor are sucked through the nozzle to clean the floor. A general configuration of such an uptight vacuum cleaner is already well known from many documents, so its detail description is omitted. Meanwhile, a suction fan for sucking outer air and a motor providing a rotational force for rotation of the suction fan are built in a main body of the vacuum cleaner.

In operation of the vacuum cleaner, as the motor built in the main body rotates, rotational force of the motor is transferred to the suction fan so that a negative pressure is generated by the suction fan. The negative pressure interacts with the nozzle unit, so that outer air is sucked through the nozzle unit, foreign particles contained in the sucked outer air are filtered by a dust collection assembly, the filtered air is introduced into the suction fan and the motor, and is then exhausted.

Meanwhile, when a lot of foreign particles are accumulated in the dust collection assembly or fabric, such foreign particles may prevent outer air from being sucked into the motor. If the outer air is not sucked into the motor, the motor is overheated, resulting in damage to the motor or a shortened life span of the motor.

Considering the above problems, a damper is installed at a suction side of the motor. When an excessive negative pressure is generated in a passage of the suction side of the motor, the damper sucks the outer air.

However, in case where an excessive negative pressure as generated in the damper, the damper may be separated from its support and fall into an inside of the main body of the vacuum cleaner. The falling damper damages the motor. Also, since all air of the suction fan is sucked through an installation hole of the damper, outer air may not be sucked through the nozzle unit.

Further, in case the damper falls into the inside of the main body of the vacuum cleaner and an object such as a bar is sucked through the installation hole of the damper, the vacuum cleaner may be damaged in an initial stage of the operation. Furthermore, if a user's finger falls into the installation hole, the user may be injured.

Moreover, if the damper does not have a suction space of a proper size, the amount of air by-passed through the damper is decreased, so that the functions of the damper may be not performed properly.

SUMMARY OF THE INVENTION

Accordingly, the present invention is directed to a vacuum cleaner and a damper installation structure thereof that substantially obviate one or more problems due to limitations and disadvantages of the related art.

An object of the invention is to provide a vacuum cleaner and a damper installation structure thereof that can improve stability in using the vacuum cleaner.

Another object of the invention is to provide a vacuum cleaner and a damper installation structure thereof that can enhance the functionality in the use of the damper by allowing more amount of air to be by-passed and sucked by an operation of the damper in using the vacuum cleaner.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vacuum cleaner comprising: a cover of a main body of the vacuum cleaner; a dust collection unit by which foreign particles contained in air are filtered and collected; an airflow passage through which the air exhausted from the dust collection unit is guided to a motor; a suction motor disposed at a portion of the cover, for sucking air; a damper selectively opened or closed by an inner air pressure of the airflow passage; and a damper support member receiving the damper therein and formed at the cover, for preventing the damper from falling into an inner space of the airflow passage.

In another aspect of the invention, there is provided a damper installation structure of a vacuum cleaner, comprising: an airflow passage formed at a suction side of a motor, for generating a suction force; a damper formed at a portion where an outer boundary of the damper communicates with the airflow passage; and a plurality of support bars by which the damper is supported, the support bars extending in a vertical direction at an outside of the damper such that air is by-passed and smoothly introduced from the damper.

In another aspect of the invention, there is provided a damper installation structure of a vacuum cleaner, comprising: a damper by which an inside or an outside is selectively shielded; and a damper support member supporting a position of the damper by a plurality of support bars branched and extended in a vertical direction at an outside of the damper spaced apart from the damper.

According to the vacuum cleaner and the damper installation structure thereof provided in the present invention, convenience and stability in using the vacuum cleaner are further enhanced.

In addition, since the functionality in using the vacuum cleaner is improved, the motor of the vacuum cleaner is basically prevented from being damaged, thereby enhancing the stability in use of the vacuum cleaner.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
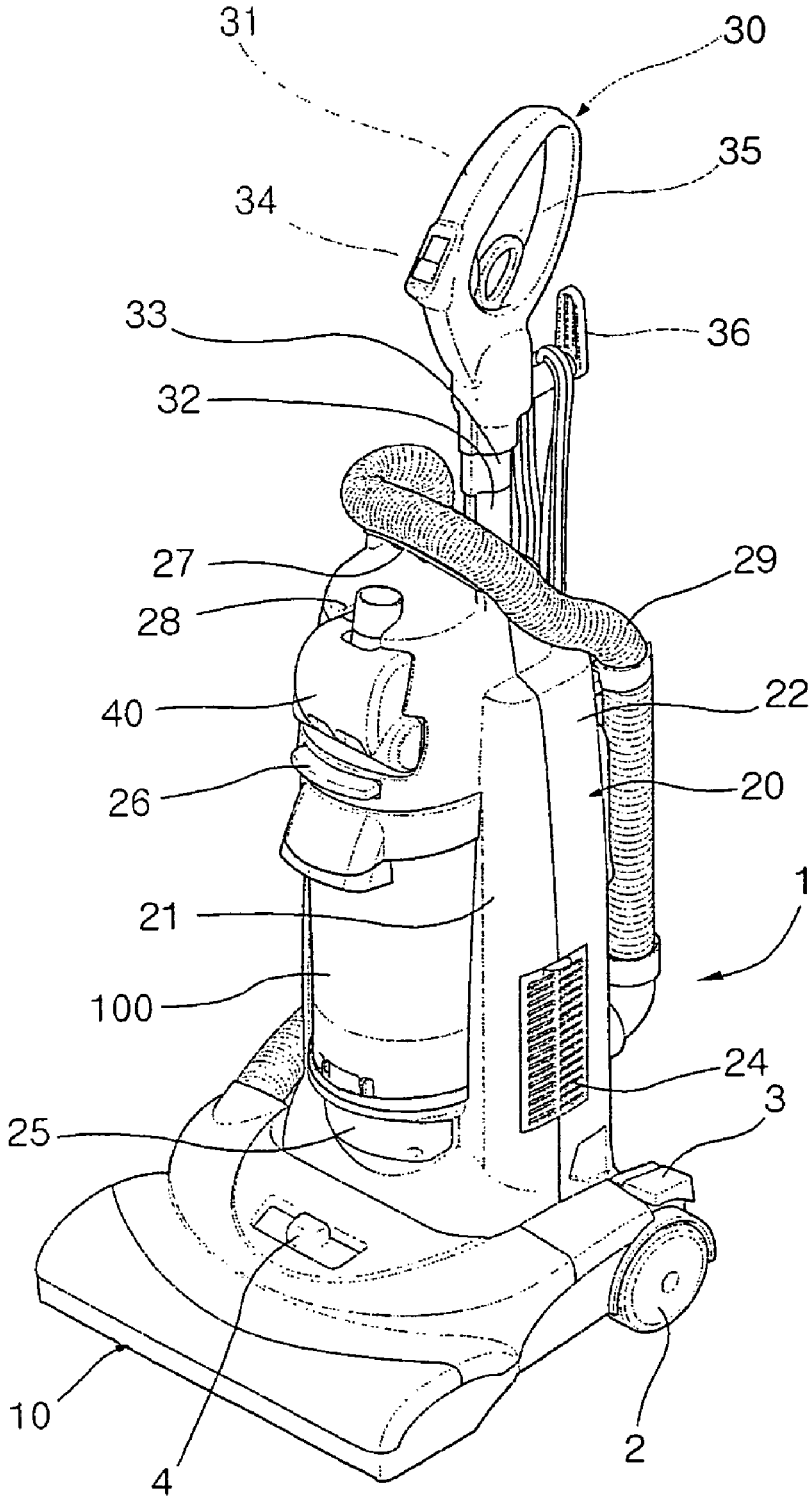
FIG. 1 is a front perspective view of an upright vacuum cleaner according to the present invention.
Figure 2:
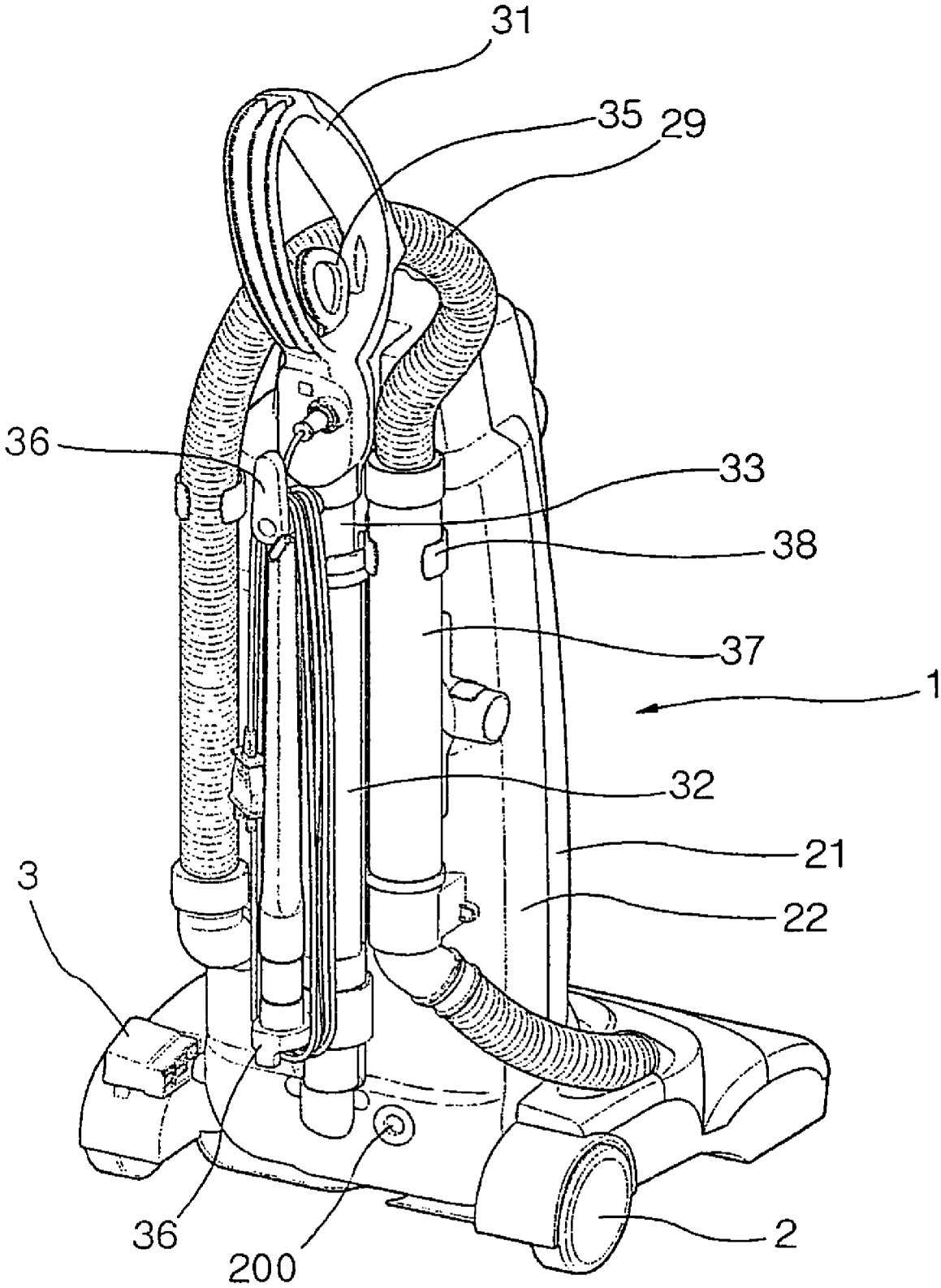
FIG. 2 is a rear perspective view of an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 macroscopically includes a suction nozzle unit 10 that contacts with a floor to suck outer air, a body 20 in which main parts including a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked trough the suction nozzle unit 10 together with foreign particles. The foreign particles are separated from the sucked air while passing trough the body 20 and cleaned, and then the cleaned air is exhausted through a predetermined discharge hole. In addition, in order to move the vacuum cleaner to a desired position, a user grips the manipulation handle 30 of the vacuum cleaner and then pulls or pushes the vacuum cleaner 1.

In detail, the suction nozzle unit 10 is used for sucking outer air and has a substantially rectangular shape with an opening opened toward the floor. The suction nozzle unit 10 is hinged to the body 20, and a pivoting lever 3 controls this hinge movement. In addition, for better movement of the suction nozzle unit 10, the suction nozzle unit further includes wheels 2 installed at a rear portion of the suction nozzle unit 10, and a height control knob 4 installed on an upper surface of the suction nozzle unit 10 for height control of the suction nozzle unit 10. The air sucked into the suction nozzle unit 10 is guided to the body 10 by means of a hose 29. For this purpose, hot ends of the hose 29 are connected to the suction nozzle unit 10 and the body 20, respectively.

In detail, the body 20 includes a front case 21 for protecting a front portion of the body 20 and a rear case 22 for protecting a rear portion of the body 20, and the front and rear portions are fixed with each other by, for example, being fitted or screwed to one another. Furthermore, the body 20 is provided with a dust collecting unit 100 for collecting dusts from the air sucked through the hose 29, a detachable lever 26 for separating the dust collecting unit 100 from the body 20 in a convenient way, a discharge cover 24 formed in a side of the body 20 for allowing the air free from foreign particles to be discharged, a lamp 25 for lighting the floor at night so that the vacuum cleaner may be manipulated in a convenient way, a mini nozzle seat 28 concaved in the top of the front case 21, and a mini nozzle 40 selectively received in the mini nozzle seat 28. The mini nozzle 40 may be used for cleaning places that are not directly contacted with the main body of the upright cleaner like a corner and received in the mini nozzle seat 28. Inside the dust collection unit 100, a cyclone type dust collection member capturing foreign particles and a filtering type dust collection member separating foreign particles can be formed respectively. The two dust collection members are disposed inside the body 20.

In addition, the body 20 is also provided on its rear side with a cord hook 36 protruded at upper and lower positions of the body 20 so that a power cord may be wound thereon, a hose guide 37 that configures at least a part of the hose 29 and is made of strong materials unlike the hose 29, and a holder 38 protruded on the rear side of the body 20 so as to support the hose guide 37. The hose guide 37 is used for convenient positioning of the mini nozzle 40 when the mini nozzle is used in connec don to the hose 29.

Meanwhile, to the hose guide 37, another suction nozzle unit like the mini nozzle 40 may be conveniently connected. For this purpose, one end of the hose guide 37 connected to the hose 29 is easily separated, and then another suction nozzle unit such as the mini nozzle 40 may be connected thereto. In addition, the hose 29 has a bellows shape, so its length may be shortened while stored and elongated over five times when being used by a user. Thus, the hose 29 allows a user to clean a place far away from the main body of the vacuum cleaner.

In addition, at the top of the front case 21, the hose 29 may be seated in a shrunk state, and a moving handle 27 is formed for a user to grip to carry the vacuum cleaner. The moving handle 27 may be used not only for holding and carrying the vacuum cleaner but also for holding the hose 29.

In detail, the manipulation handle 30 includes a handle 31 for a user to grip conveniently while the vacuum is operating, and an operation switch 34 formed at a predetermined position of the handle 31 and used for controlling operation of the vacuum cleaner itself such as initiation of operation of the vacuum switch and suction force of the vacuum cleaner. In addition, a length of the manipulation handle 30 may be conveniently adjusted. In more detail, for adjustment of length, the manipulation handle 30 includes an extension pipe 33 extended downward to the handle 31, and a fixed pipe 32 that supports the extension pipe 33 and allows the extension pipe 33 to be moved through it by means of selective manipulation of an extension lever 35 so that the length of the manipulation handle 30 may be shortened or elongated.

The present invention mainly has an interest on an installation structure of a damper 200, which allows air to be by-passed and sucked toward a motor when the motor is overheated. The damper 200 is installed at a lower side of the rear case 22. The damper 200 is opened when the air sucked into the motor is in an excessive negative pressure state such that outer air is sucked through the damper 200 and is introduced into the motor. Accordingly, the damper prevents the motor from being overheated and damaged, so that the life span of the motor increases.

Figure 3:
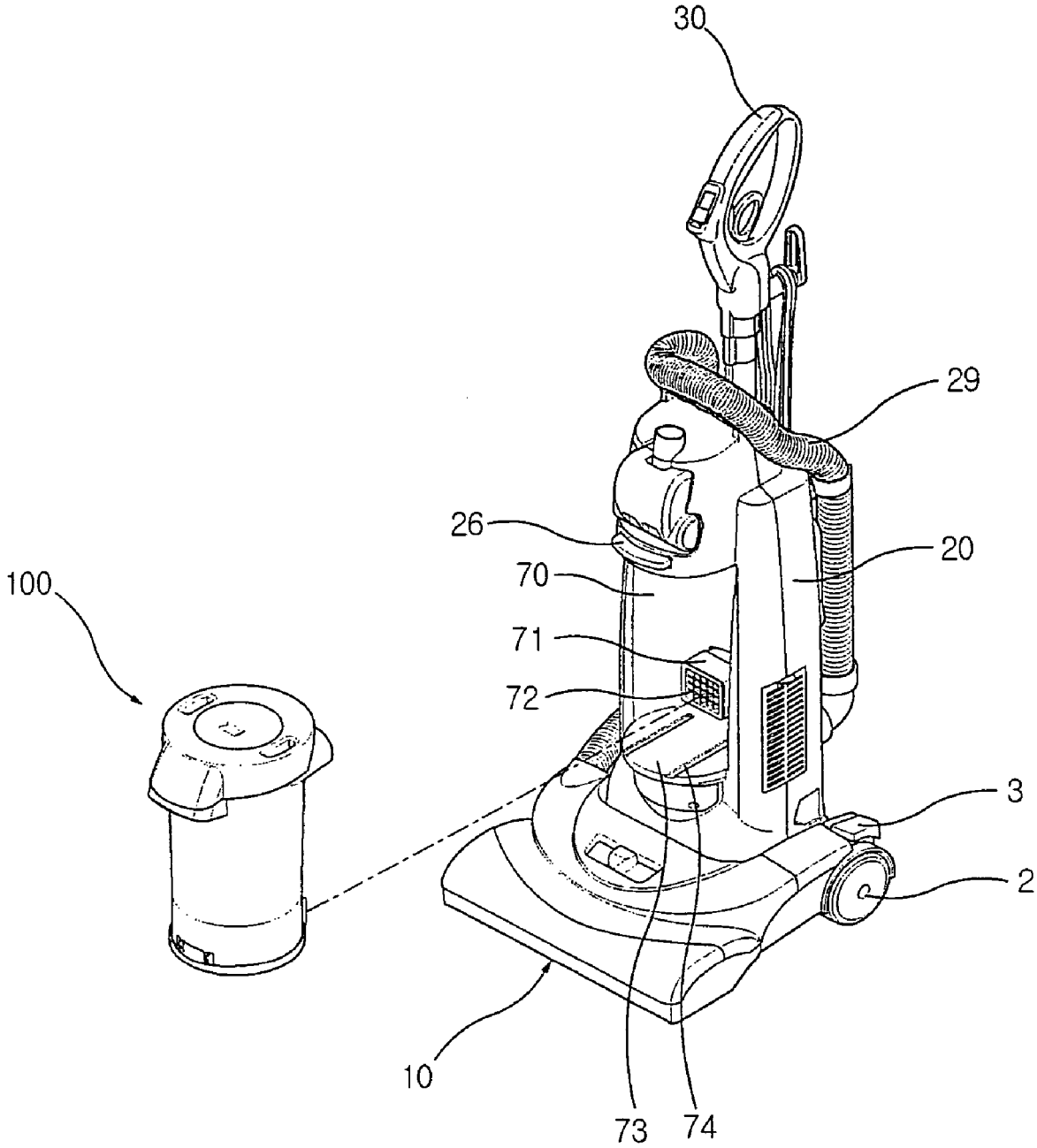
FIG. 3 is an exploded perspective view showing a state of when a dust collection unit is disassembled from a vacuum cleaner of the present invention.

FIG. 3 is an exploded perspective view showing a state of when the dust collection unit is disassembled from a vacuum cleaner of the present invention.

Referring to FIG. 3, the body 20 is provided therein with a motor (not shown) for generating a suction force and a suction fan (not shown) rotating using a power of the motor such that outer air and foreign particles are sucked through the suction nozzle unit 10. A dust collection unit seat 70 is formed at a central portion of the body 20. The dust collection unit seat 70 is concaved toward an inside of the body 20 from a front side of the body 20 such that the dust collection unit 100 is inserted into and installed at the dust collection unit seat 70.

In detail, a suction unit 71 that is an air introduction path is formed protruding from a rear surface of the dust collection unit seat 70. The suction unit 71 communicates with a discharge hole (not shown) of the dust collection unit 100. Therefore, the air introduced into the dust collection unit 100 from the body 20 is filtered at the dust collection unit 100 and then is again introduced into the inside of the body through the suction unit 71. The suction unit 71 is protruded so as to be exactly aligned with the discharge hole (not shown) because the discharge hole (not shown) of the dust collection unit 100 is concaved toward an inside of the dust collection unit 100.

A filter 72 is attached on a front surface of the suction unit 71 to filter foreign particles contained in air introduced thereinto. In particular, the filter 72 filters foreign particles which were not filtered by the dust collection unit 100 and introduced into the inside of the body 20, thereby preventing components such as a motor (not shown) built in the body 20 from being damaged. In addition, the dust collection unit seat 70 includes a pair of guide grooves 74 formed in a bottom surface 73 thereof in a front and rear direction thereof. The pair of guide grooves 74 are aligned with guide protrusions (not shown) formed at a lower surface of the dust collection unit 100 such that the dust collection unit 100 is exactly inserted into the dust collection unit seat 70. Of course, the bottom surface 73 of the dust collection unit seat 70 supports the weight of the dust collection unit 100.

The dust collection unit 100 seated on the dust collection unit seat 70 of the body 20 is shaped in a cylinder such that foreign particles are filtered in a cyclonic manner. The dust collection unit 100 filters foreign particles contained in the air sucked through the suction nozzle unit 10 and it is detachably assembled in the dust collection unit seat 70. The dust collection unit can collect foreign particles therein in a cyclonic manner, using a separate filter, or using the cyclone and the filter at the same dine.

The body is further provided at a front surface thereof with the detachable lever 26. The detachable lever 26 moves up and down centering on a hinge shaft (not shown). One end of the detachable lever 26 is latched on a detachable groove (see 142 of FIG. 4) of the dust collection unit 100. Accordingly, the detachable lever 26 is used to fix an upper side of the dust collection unit 100, or is used to separate the dust collection unit 100 as a user manipulates the detachable lever 26 to release the latch between the detachable groove 142 and the dust collection unit 100.

Figure 4:
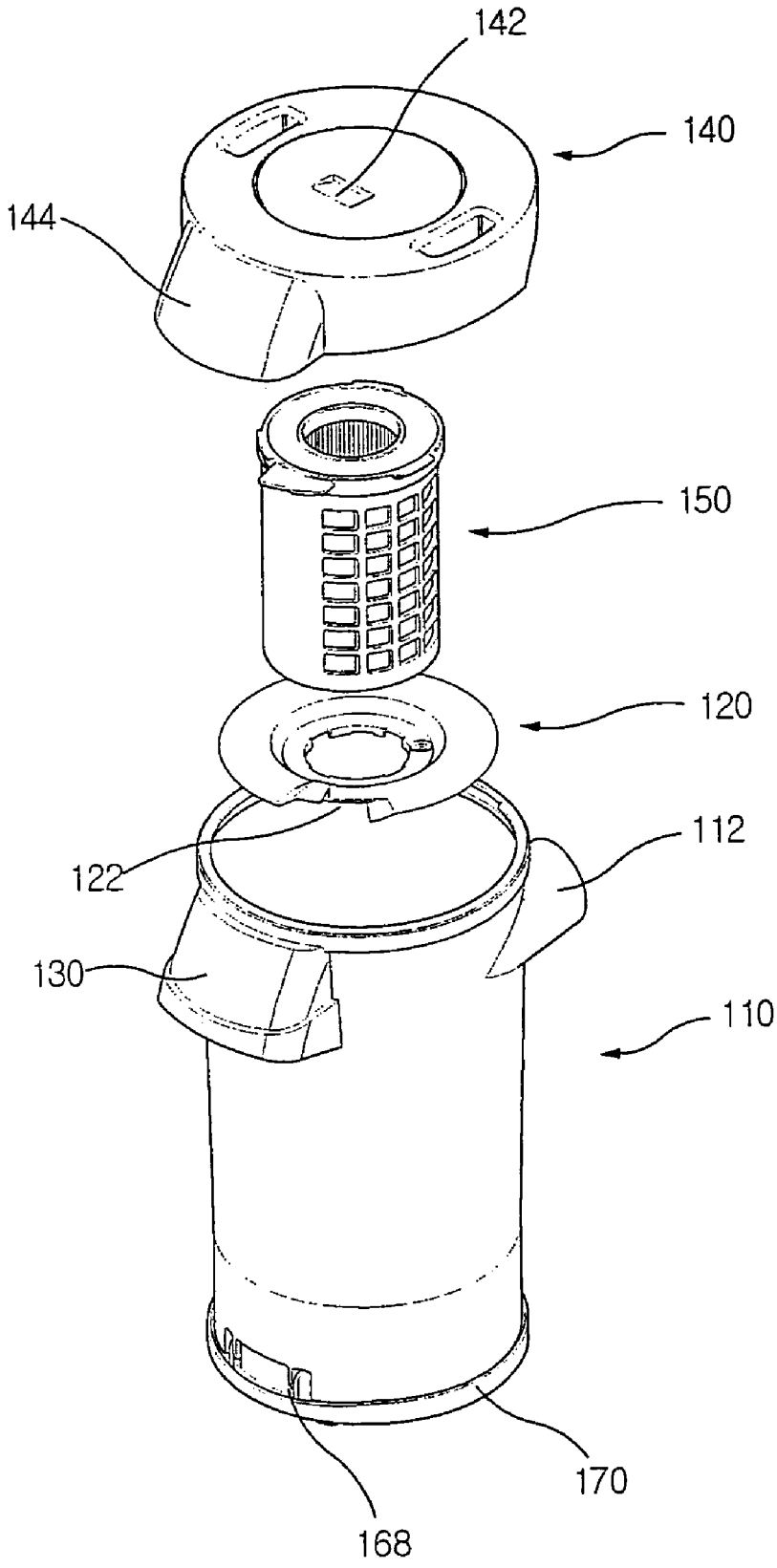
FIG. 4 is a disassembled perspective view of the dust collection unit.

FIG. 4 is a perspective view of the dust collection unit.

Referring to FIG. 4, the dust collection unit 100 includes a cylindrical dust collection container 110 forming the appearance of the dust collection unit 100. A suction guide 112 is formed at an upper side portion of the dust collection container 110. The suction guide 112 is protruded outward from the dust collection container 110 to guide the air introduced into the dust collection container 110 such that the air flows in a tangential direction along an inner wall of the dust collection container 110. Accordingly, the suction guide 112 is protruded along the tangential direction of the dust collection container 110. Also, the cylindrical shape of the dust collection container 110 is used for rotating the sucked air.

Inside the dust collection container 110, a separation plate 120 is disposed to separate foreign particles having a relatively high weight in the foreign particles contained in the introduced air at a lower side of the dust collection container 110. Inner space of the dust collection container 110 is partitioned into an upper space and a lower space by the separation plate 120. The separation plate 120 is formed having an outer diameter smaller than an inner diameter of the dust collection container 110 such that the foreign particles drop. In addition, the separation plate 120 has a communication hole 122 formed in a vertical direction to guide a downward drop of the separated foreign particles. In other words, the foreign particles contained in the air passes through the communication hole 122 of the separation plate 120 and are moved downward. Also, the separation plate 120 has a central portion concaved by a predetermined depth so as to mount a filter assembly 150 thereon.

In addition, a handle 130 is formed at the other outer circumferential surface of the suction guide 112. The handle 130 is protruded toward a lateral direction from an upper portion of the dust collection container 110 to allow a user to separate and couple the dust collection unit 100 from the body 20 with ease.

Also, an upper surface of the dust collection container 110 is shielded by an upper cover 140. The upper cover 140 is openably and closably installed at an upper side of the dust collection container 110. The upper cover 140 has a detachable groove 142 formed downward at an upper central portion thereof. A rear end of the detachable lever 26 is latched on the detachable groove 142. The upper cover 140 also includes a handle cover 144 formed at a side portion thereof, for covering the handle 130. The handle cover 144 is formed in a shape corresponding to the appearance of the handle 130.

In addition, a lower cover 170 is hinge-coupled to a lower portion of the dust collection container 110. When the inside of the lower cover 170 is full of foreign particles, the foreign particles can be conveniently discharged to an outside by a hinge movement of a hinge portion 168.

Figure 5:
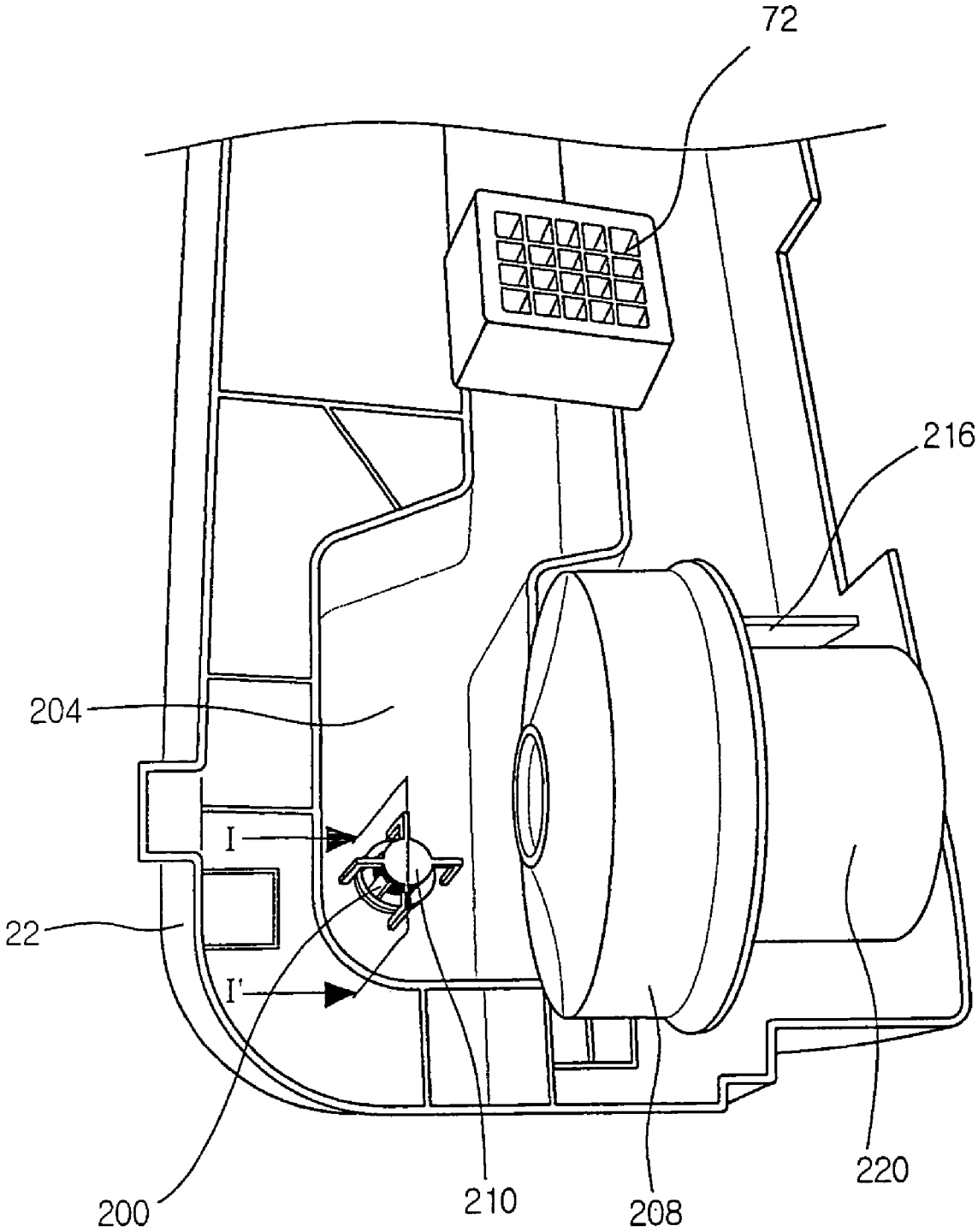
FIG. 5 is an inner perspective view of the rear cover.

FIG. 5 is an inner perspective view of the rear cover.

Referring to FIG. 5, the rear cover 22 is provided therein with a suction fan 208, a motor 220 transferring rotational force to the suction fan 208, an airflow passage 204 for guiding air sucked through the filter 72 to the suction fan 208, and a motor housing 216 for fixing the motor 220 to the rear cover 22. In addition, a damper support member 210 on which the damper 200 is mounted is formed at a predetermined portion of the airflow passage 204.

According to the above construction of the rear cover, when an excessive negative pressure is generated inside the airflow passage 204, the damper 200 is opened such that outer air can be introduced into the inside of the airflow passage 204. The air introduced into the airflow passage 204 through the damper 200 is sucked into the suction fan 208 to prevent the motor 220 from being overheated. In addition, the excessive negative pressure in the airflow passage 204 may be generated when the inside of the dust collection unit 100 is full of foreign particles such that outer air is not sucked, and when a foreign material such as clothing is in contact with the nozzle to shield the suction hole of the nozzle such that outer air is not sucked.

Hereinafter, the damper and the installation structure of the damper will be described in detail.

Figure 6:
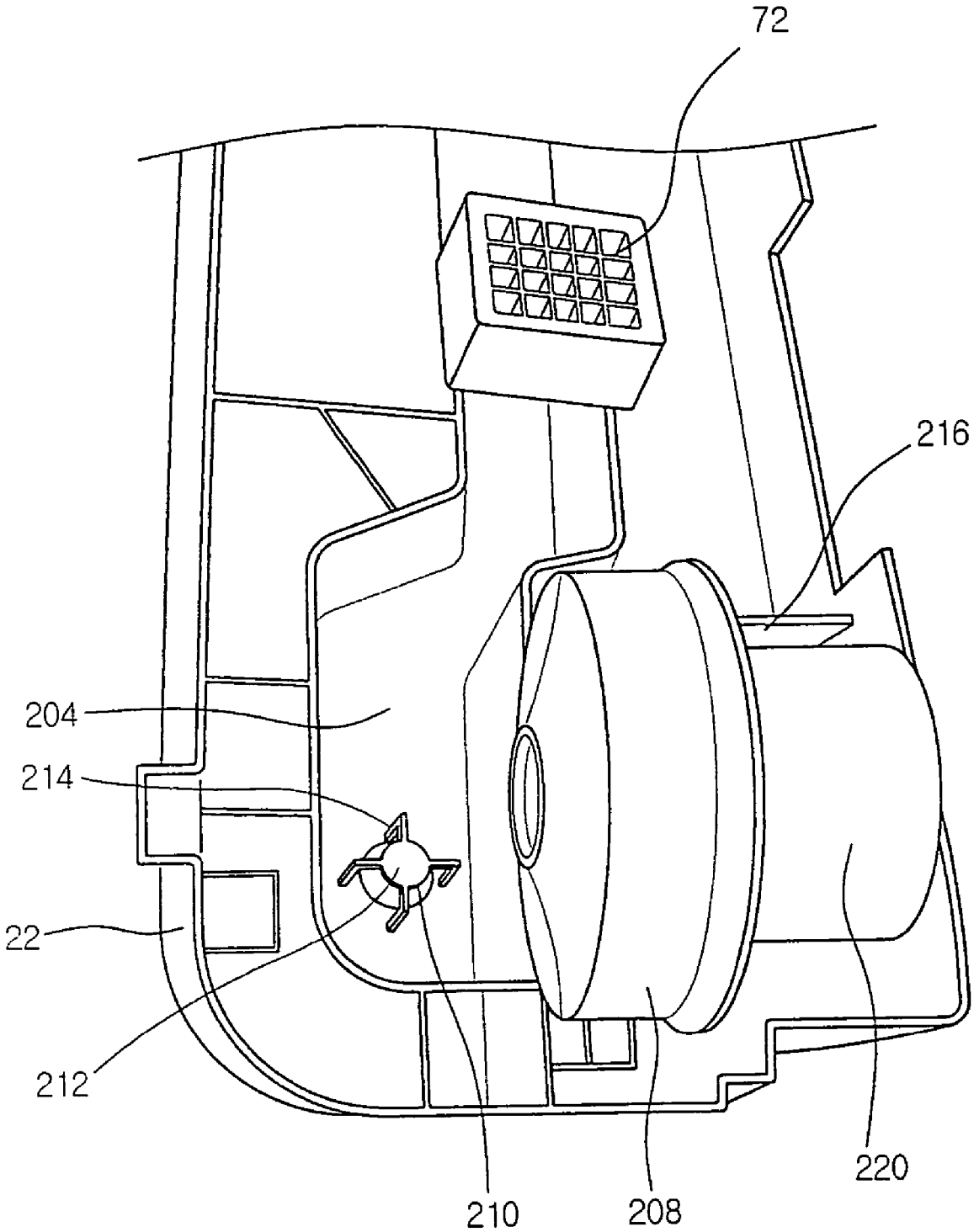
FIG. 6 is a perspective view of the rear cover showing the damper support member in a state that the damper is not installed.
Figure 7:
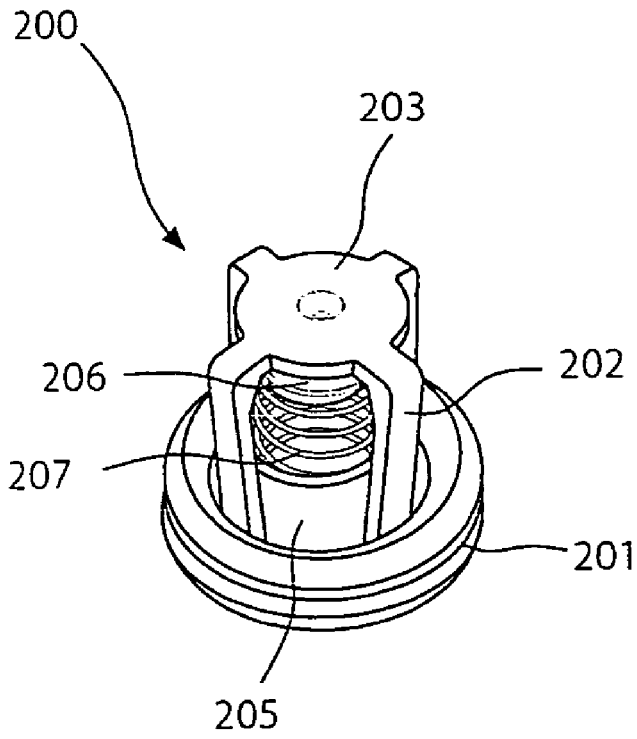
FIG. 7 is a perspective view of the damper.

FIG. 6 is a perspective view of the rear cover showing the damper support member in a state that the damper is not installed, and FIG. 7 is a perspective view of the damper.

Referring to FIGS. 6 and 7, the damper support member 210 receives the damper 200 therein to support the damper 200, and includes four damper support bars 214 extending upward, and an escape preventing surface 212 connecting at least two of the four damper support bars 214 and supporting an upper end surface of the damper 200. The damper support bars 214 support a side of the damper 200 such that the damper 200 is not shaken in a lateral direction. The escape preventing surface 212 supports the upper end surface of the damper 200 such that the damper 200 is inserted into the inside of the main body of the vacuum cleaner and does not escape therefrom. Further, the escape preventing surface 212 prevents a user's finger from being inserted into the damper 200, thereby securing the user's safety. Further, the escape preventing surface 212 prevents a bar-shaped element, such as a chopstick, from being introduced into the damper 200, thereby preventing the vacuum cleaner from being damaged.

In the meanwhile, the damper 200 is inserted into an inside of the vacuum cleaner from an outside and is fixed to an inner surface of the support member 210. In detail, the damper 200 includes an installation part 201 for fixing position of the damper 200 inserted into the outer circumference of the rear cover 22, a guide part 202 having one end fixed to the installation part 201 and a plurality of branches branched upward, a support surface 203 formed by connecting at least two upper ends of the branches of the guide part 202, a compressive spring 207 inserted into an inside of the guide part 202, and an installation protrusion 206 protruded toward a downward direction of the support surface 203 such that an upper end of the compressive spring 207 is faxed with respect to the support surface 203.

In addition, the damper 200 further includes a shielding member 205 disposed below the compressive spring 207, for controlling inflow and outflow of outer air. When the shielding member 205 is compressed downward by the compressive spring 207, it contacts the installation part 201 to perform a sealing such that outer air is not introduced through the damper 200. In particular, the installation part 201 is preferably made of a flexible rubber such that it is elastically deformed and fixed on an inner surface of the rear cover 22. Thus, the installation part 201 made of flexible rubber reliably prevents outer air from being sucked into the damper 200.

Figure 8:
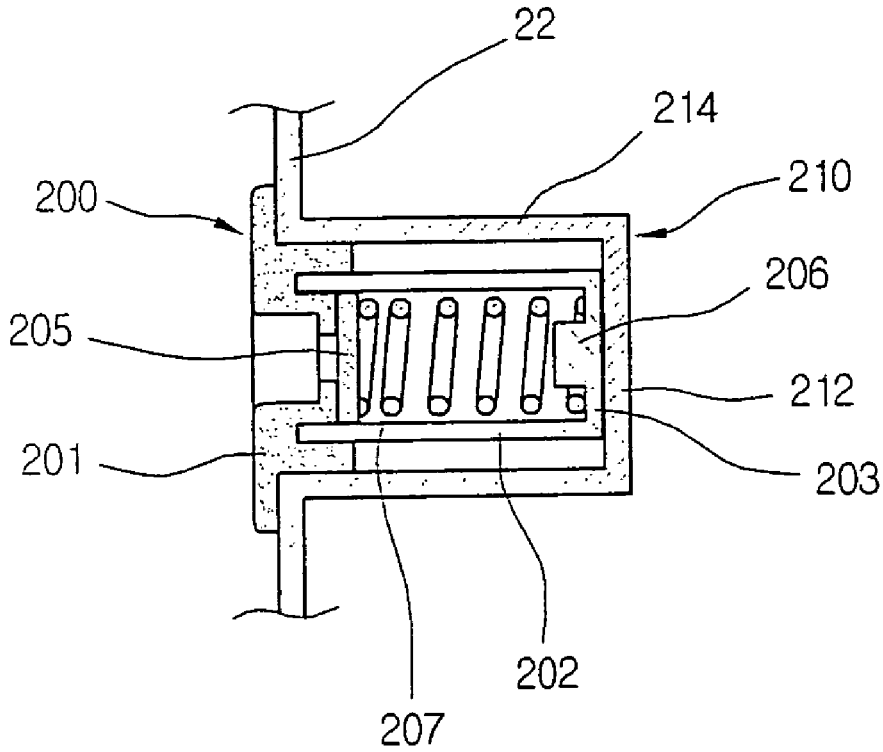
FIG. 8 is a sectional view taken along the line I-I' of FIG. 5.

FIG. 8 is a sectional view taken along the line I-I' of FIG. 5. The damper installation structure will now be described with reference to FIG. 8.

Referring to FIG. 8, the damper 200 is fixed to the rear cover 22 by the installation part 201. Inside the installation part 201, the shielding member 205 and the compressive spring 207 are disposed. The guide part 202 is disposed outside the compressive spring 207 to guide the position of the compressive spring 207.

Also, the damper support member 210 includes the support bars 214 and the escape preventing surface 212. The support bars 214 supports a horizontal position of the damper 200 and the escape preventing surface 212 prevents the damper from falling into the inside of the main body of the vacuum cleaner. In addition, since the plurality of support bars of the support bars 214 are branched, they do not hinder the suction of outer air but allow the outer air to be more smoothly by-passed and sucked through the damper 200.

The operation of the damper will now be described with reference to the above-described construction.

When an excessive negative pressure is generated in the airflow passage 204, the shielding member 205 is subject to a force lifting the shielding member 205 inward. This lifting force corresponds to a difference value between a pressure difference value and the compressive force of the compressive spring 207, wherein the pressure difference value is a difference value between the negative pressure and the atmosphere pressure. If the inner pressure of the airflow passage 204 does not reach the lifting force, the damper does not operate and the outer air is not naturally by-passed and sucked. The outer air sucked through the damper 200 is introduced into the inside of the airflow passage 204 through spaces between the support bars 214.

In the operation of the damper 200, a repulsive force of the compressive spring 207 is applied to the support surface 203 to push the damper 200. However, since the force pushing the damper 20 is impeded by the escape preventing surface 212, the damper 200 does not fall into the inside of the airflow passage 204. In addition, when the inner negative pressure of the airflow passage 204 is not high, the shielding member 205 is pushed downward by a restoring force of the compressive spring 207 and returns to the original position. At this time, since the shielding member 205 contacts the installation part 201 to seal the inner space, outer air is not sucked through the damper 200.

According to the present invention, since the damper is prevented from escaping during its operation, disorder due to the escape of the damper decreases.

Also, when outer air is introduced through the damper, since the spaces between the support bars are sufficiently large, more amount of air is by-passed and sucked.

In addition, even when the damper is removed, an undesired foreign element is prevented from being introduced through the inside of the vacuum cleaner, so that a user's safety is enhanced and reliability of the vacuum cleaner is improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A vacuum cleaner, comprising:

a cover forming at least a portion of a main body of the vacuum cleaner;

a dust collection device by which foreign particles contained in air are filtered and collected;

a suction motor that sucks air;

an airflow passage through which the air exhausted from the dust collection device is guided to the suction motor;

a damper selectively opened or closed by an inner air pressure of the airflow passage, wherein the damper comprises a compressive spring to which a compressive force is applied, a shielding member formed at one end of the compressive spring that shields outer air when pushed, and a support surface having a lower part which supports another end of the compressive spring; and a damper support member that receives the damper therein and which is coupled to or formed in the cover, and that prevents the damper from falling into an inner space of the airflow passage, wherein the damper support member comprises an escape preventing surface configured to cover an upper part of the support surface and to support the damper and wherein a flexible installation part fixes the damper to the cover and has a first opening; and a guide part coupled between the support surface and the flexible installation part and having a plurality of second openings, wherein the guide part includes a plurality of branches and the second openings are formed between respective ones of said branches, wherein air flows along a path that extends between the first opening and the second openings when the spring compresses to move the shielding member away from the first opening, and the damper support member includes a plurality of support bars coupled to the escape preventing surface, and the second openings pass through spaces formed between the support bars and the branches of the guide part.

2. The vacuum cleaner according to claim 1, wherein the damper support member is formed in the airflow passage.

3. The vacuum cleaner according to claim 1, wherein the damper support member protrudes toward an inside of the cover.

4. The vacuum cleaner according to claim 1, wherein the vacuum cleaner is an upright vacuum cleaner and the cover is a rear cover of the upright vacuum cleaner.

5. The damper support structure according to claim 1, wherein the plurality of support bars are formed at an equal interval.

6. The damper support structure according to claim 1, wherein one end of the support surface is supported by or coupled to one of the ends of the compressive spring and another end of the support surface is supported by or coupled to the escape preventing surface.

7. The vacuum cleaner according to claim 1, wherein the flexible installation part is formed of rubber.

8. The vacuum cleaner according to claim 1, wherein at least one of the support surface or the escape preventing surface is aligned along an axis passing through the first opening in the flexible installation part to divert the air flowing through the first opening in the flexible installation part through the at least one second opening of the guide part, and wherein the at least one second opening is aligned along an axis different from said axis passing through the first opening in the flexible installation part.

9. The vacuum cleaner according to claim 8, wherein the support surface and the escape preventing surface are aligned along said axis passing through the first opening to divert the air flowing through the first opening through the at least one second opening.

10. The vacuum cleaner according to claim 1, wherein the support bars are in alignment with the branches to form a plurality of second openings.

11. The vacuum cleaner according to claim 10, wherein the support bars are in alignment with the branches to allow the spaces between the support bars to be aligned with spaces between the branches of the guide part to form said plurality of second openings.

12. The vacuum cleaner according to claim 1, wherein the spring is located entirely within the cover.

13. The vacuum cleaner of claim 8, wherein at least one of the support surface or the escape preventing surface blocks air from passing out of the damper support member along said axis passing through the first opening in the flexible installation part.

* * * * *